US009370261B1

(12) United States Patent
Strandberg et al.

(10) Patent No.: US 9,370,261 B1
(45) Date of Patent: Jun. 21, 2016

(54) INCLINED PULMONARY-ASSISTING MATTRESS FOR INFANTS AND CHILDREN

(71) Applicants: Gun B. C. Strandberg, Spring Hill, FL (US); Jessica C. Kent, Ackworth, GA (US)

(72) Inventors: Gun B. C. Strandberg, Spring Hill, FL (US); Jessica C. Kent, Ackworth, GA (US)

( * ) Notice: Subject to any disclaimer, the term of this patent is extended or adjusted under 35 U.S.C. 154(b) by 0 days.

(21) Appl. No.: 14/696,399

(22) Filed: Apr. 25, 2015

(51) Int. Cl.
*A47C 16/00* (2006.01)
*A47D 15/00* (2006.01)
*A47D 9/00* (2006.01)

(52) U.S. Cl.
CPC ..... *A47D 15/001* (2013.01); *A47D 9/00* (2013.01); *A47D 15/008* (2013.01)

(58) Field of Classification Search
CPC ..... A47D 15/001; A47D 15/008; A47D 9/00
See application file for complete search history.

(56) References Cited

U.S. PATENT DOCUMENTS

| | | | | | |
|---|---|---|---|---|---|
| 2,495,482 | A * | 1/1950 | Rogatz | 297/467 |
| 3,269,621 | A * | 8/1966 | Dishart | 224/585 |
| 4,667,356 | A * | 5/1987 | Holmquist | 5/655 |
| 4,825,487 | A * | 5/1989 | Eberl | 5/655 |
| 5,014,376 | A * | 5/1991 | Doran et al. | 5/603 |
| 5,297,300 | A * | 3/1994 | Sheu | 4/572.1 |
| 5,383,711 | A * | 1/1995 | Houghteling | 297/397 |
| 5,439,008 | A * | 8/1995 | Bowman | 128/875 |
| 5,440,770 | A * | 8/1995 | Nichols | 5/655 |
| 5,937,461 | A * | 8/1999 | Dombrowski et al. | 5/655 |
| 6,036,263 | A * | 3/2000 | Gold | 297/219.12 |
| 6,363,558 | B1 * | 4/2002 | Dunne | 5/655 |
| 6,381,787 | B1 * | 5/2002 | Rogone et al. | 5/655 |
| 6,922,861 | B1 * | 8/2005 | Mathis | 5/655 |
| 7,930,781 | B1 * | 4/2011 | Dana et al. | 5/655 |
| 8,302,230 | B1 * | 11/2012 | Jarrett et al. | 5/655 |
| 8,341,781 | B1 * | 1/2013 | Bleser | 5/655 |
| 8,572,782 | B1 * | 11/2013 | Amini | 5/655 |
| 8,756,736 | B1 * | 6/2014 | Minson | 5/711 |
| 8,769,737 | B1 * | 7/2014 | Duggins | 5/93.1 |
| 2002/0153753 | A1 * | 10/2002 | Kassai | 297/216.11 |
| 2004/0168257 | A1 * | 9/2004 | Torrez | 5/731 |
| 2005/0000022 | A1 * | 1/2005 | Houghteling | 5/655 |
| 2005/0115000 | A1 * | 6/2005 | Kassai et al. | 5/655 |
| 2006/0016013 | A1 * | 1/2006 | Lord et al. | 5/655 |
| 2007/0283502 | A1 * | 12/2007 | Tullous | 5/733 |
| 2009/0235461 | A1 * | 9/2009 | Straub | A47D 15/008 5/655 |
| 2010/0229301 | A1 * | 9/2010 | Arnold et al. | 5/93.2 |
| 2010/0287706 | A1 * | 11/2010 | Nour | 5/655 |
| 2011/0056025 | A1 * | 3/2011 | Jew et al. | 5/724 |
| 2011/0162657 | A1 * | 7/2011 | Tullous | 128/845 |

(Continued)

*Primary Examiner* — David E Sosnowski
*Assistant Examiner* — Morgan McClure
(74) *Attorney, Agent, or Firm* — Dorothy S. Morse

(57) ABSTRACT

An inclined pulmonary-assisting mattress with a profile assisting infants and small children with respiratory problems and other adverse medical conditions, including asthma, wheezing, colic, SIDS, ear infections, and acid reflux. It can be used with a crib, bassinette, or other defined infant sleeping area, as long as it appropriately fills that sleeping area to eliminate all injury, entrapment, or breathing obstruction risk for the child using it. The mattress is not used on top of a crib mattress, but instead replaces a crib mattress until the child recovers or outgrows the breathing difficulty or adverse medical condition. At such time, the inclined pulmonary-assisting mattress is removed and the child is allowed to sleep on a regular crib mattress or other substantially horizontal surface. Intended applications include, but are not limited to, use in hospital neo-natal units, children's nurseries, and by parents of infants suffering from breathing or digestive issues.

14 Claims, 3 Drawing Sheets

(56) References Cited

U.S. PATENT DOCUMENTS

2011/0265264 A1* 11/2011 Reeder, Jr. ..... 5/640
2011/0277210 A1* 11/2011 Hardesty ..... 2/69.5
2013/0219629 A1* 8/2013 Dilley ..... 5/732

* cited by examiner

INCLINED PULMONARY-ASSISTING MATTRESS FOR INFANTS AND CHILDREN

CROSS-REFERENCES TO RELATED APPLICATIONS

None

BACKGROUND OF THE INVENTION

1. Field of the Invention

This invention relates to mattresses, specifically to an inclined pulmonary-assisting mattress with a defined profile that assists infants and small children with asthma, wheezing, colic, acid reflux, sudden infant death syndrome (SIDS), cerebral palsy, and other adverse medical conditions involving at least one breathing or digestive issue. It is beneficial for children suffering from ear infections, as well, as pressure tends to build up, causing a lot of pain for children sleeping in a flat position.

The inclined pulmonary-assisting mattress of the present invention can be used with a crib, bassinette, and other sleeping area where its size appreciably fills or otherwise complements the area to eliminate all risk of infant/child injury, entrapment, and breathing obstruction. With increased adult supervision, and particularly when used with younger children who do not reposition themselves frequently during sleep, the pulmonary-assisting mattress of the present invention can be placed on a floor or other flat surface in a position away from objects (soft or hard), young siblings, or access by pets or other things that could impair the health or well being of the infant or small child while asleep.

In addition, the present invention inclined pulmonary-assisting mattress is not used on top of another mattress, such as a crib mattress, but instead replaces a crib mattress until the infant recovers or outgrows the breathing difficulty, other adverse medical condition, or the present invention's defined profile which is most beneficial for those with smaller stature. Thereafter, when no longer needed to assist with a medical condition, or when its defined profile is no longer beneficial, the present invention inclined pulmonary-assisting mattress is removed and replaced by a different mattress or sleeping support. Intended applications for the present invention include, but are not limited to, use in hospital neo-natal units, children's nurseries, and by parents of infants or small children suffering from at least one breathing or digestive issue/disorder.

2. Description of the Related Art

Wedge-shaped pillows are commonly sold in retail stores and on the Internet to assist adults with acid reflux disease while they sleep. These pillows are used on top of a mattress or other flat surface to elevate the head and a portion of the upper torso so that the upper end of the esophagus becomes positioned at a higher elevation than the stomach, reducing esophageal damage and tooth erosion by stomach acid during sleep. In addition, a search of U.S. Patent records revealed a variety of devices that provide a non-planar sleeping surface for many different applications, including inflatable mattresses, cushion assemblies, mattresses with added support in specific locations for orthopedic use, immobilizers used for imaging and radiation therapy purposes, and a hunting mat usable under a sleeping person which has an elevated surface for the head.

Three of these inventions, those in U.S. Pat. No. 5,448,790 to Saro (1995) for a Selectively Arrangeable Cushion Assembly, U.S. Pat. No. 4,171,549 to Morrell and Gray (1979) for a Cushion Arrangement, and U.S. Pat. No. 7,415,743 (2008) to Rubio for an Inclined Bed, disclose human support structures with differing cushion arrangements, each having a plurality of wedged-shaped pillows arranged in a variety of body-supporting positions that can incline the head, neck, and shoulders of the supported person above the elevation of the lower torso and/or legs. While the Saro invention was created to assist adults and children with neuro-muscular damage, the Morrell and Gray invention provides a comfortable lounge chair, and the Rubio invention provides a generally V-shaped child's bed with a fitted sheet holding all components together, all are assembled with multiple cushions that pose a risk of entrapment, breathing obstruction, or other injury to infants and small children. In contrast, the present invention inclined pulmonary-assisting mattress has a one-piece construction and is the only sleeping surface upon which an infant or small child is supported during sleep. Furthermore, the inclined bed disclosed in Rubio and another invention in U.S. Pat. No. 7,007,330 to Kuiper (2006) for a patient turning and lifting device both have high sides to retain the patient upon it during lifting/moving and other activity. However, high sides could create a breathing blockage or obstruction similar to that previously provided by parents' use of interior crib bumpers, and high sides would not be appropriate for the present invention intended for infant use. The Rubio and Kuiper inventions also lack a U-shaped concave area communicating with the bottom end of the present invention upper torso support and the inverted U-shaped convex lower torso bump/stop that maintains a child's upper torso against the inclined upper torso support.

While other mattresses and bed systems are also known that elevate a person's head and feet above the lower torso, each has at least one disadvantage that prevents safe use with infants and small children. For example, the inventions disclosed in U.S. Pat. No. 6,848,137 to Barnes (2005) for an incline-adjustable air mattress, U.S. Design Pat. D543,064 to Hale (2007) for a mattress, and U.S. Design Pat. 543,407 to Thom (2007) for a portable bed system, all have an area for engaging the seat and upper leg area of a person using it. However, the hip and upper leg supporting areas in these inventions are too long and flat to effectively maintain the minimum incline for the head, neck and upper torso of an infant or small child needed to provide it with relief from the breathing or digestive issue adversely affecting it. Instead, an infant or small child would easily and readily slip in a downwardly direction from the proper positioning needed to assist it.

Also, although the orthopedic bed with inflatable chambers disclosed in U.S. Pat. No. 5,815,862 to Rygiel (1998) may initially appear similar in structure to the present invention, it is not suitable for use with infants and small children having breathing or digestive issues. First, its inflatable lumbar supporting chamber 7 is unnecessary during use with infants and small children, and inflatable lumbar supporting chamber 7 is different in structure and purpose from the present invention protrusion (upward "bump" or "stop") which acts as a hip and leg stop to prevent a child from moving downwardly away from the beneficial incline provided by the surface intended for upper torso and head support. Furthermore, the Rygiel bed's upper foundation member is generally triangular in longitudinal cross section and does not appear to raise a user' head and upper torso significantly above the user's hip area and legs for the needed breathing relief provided by the present invention. Similar to the lumbar support of the Rygiel invention, U.S. Pat. No. 4,791,687 to Iwase (1988) discloses a substantially flat mattress with a soft structure predisposed at a predetermined lengthwise location so that it engages the lower back vertebrae to prevent them from sinking during human sleep, assuring better sleep. Although the Iwase invention teaches a soft upward protrusion from the top surface of a mattress that engages back vertebrae, the present invention's upward protrusion (convex lower torso bump/stop) provides a differing function and acts as a bump/stop engaging the hips, legs, and feet of an infant or small child to prevent it from slipping in a downward direction away from its elevated top end where the highest elevation occurs and provides it with the needed breathing assistance.

Although the hunting mat in U.S. Pat. No. 6,895,614 to Peck (2005) teaches an inclined support on one of its ends for the head and neck of a user with an inclined surface that slopes more than the 20-degree to 25-degree incline typically found in prior art sleeping devices, since it does not have a convex lower torso bump/stop to prevent an infant from moving in a downward direction toward its horizontally-extending lower section, the angled orientation of an infant or small child upon Peck's inclined surface would not be preserved for very long after initial placement on it, and there are safety issues also should the Peck hunting mat be used for infants and small children. In addition, the following inventions also would fail for one or more stated reasons if used to provide breathing or digestive assistance for an infant or small child. U.S. Pat. No. 3,680,917 to Harris (1972) discloses an inflatable cushion for a user's back and neck that is divided into ribbed sections and appears to provide a greater than 50-degree angle of elevation, which would be too steep for use with an infant or small child. Furthermore, the present invention requires the structure of a mattress, and not just a cushion for the neck and head, so that it alone supports a child at medical risk of encountering breathing problems or other difficulty once it falls asleep with its head at the same or lower elevation than its heart. The present invention also provides a convex lower torso bump/stop and has a preferred angle for its upper torso support in the range of approximately 35-degrees to 45-degrees.

In addition, the two-part mattress in U.S. Design Pat. D479,082 to Daughtry (2003), has too long an area for engaging the seat and upper leg area of an infant, which would prevent the infant from achieving the targeted incline of approximately 35-degrees to 45-degrees. Although the external immobilizer in U.S. Pat. No. 8,607,385 to Isham (2013) used for imaging purposes has illustrations showing an upward protrusion positioned to engage the back of a patient's partially-stretched knees, there is no head incline that places the lowest portion of the top surface of the present invention about three-eighths of the way downward from the top end of the present invention. Similarly, the Taricani infant support apparatus is designed to support a child lying in a prone position and to allow safe and secure positioning of the child thereon through the use of retaining straps. The Tarcani invention can be sized for use in a person's lap, while the present invention is a larger mattress that fills a crib that protects all portions of the infant using it to prevent injury or breathing obstruction. In contrast, the present invention is only used to support an infant on its back. No invention is known to have all of the features and advantages of the present invention.

SUMMARY OF THE INVENTION

The primary objective of this invention is to provide an inclined pulmonary-assisting mattress for infant and small children with structure that elevates the head, neck, and upper torso, while also having adjoining structure that prevents the infant or small child from slipping downwardly and away from the upper torso elevating portion of its structure, allowing users to remain in the most beneficial orientation wherein their breathing or digestive issues have less adverse impact on them. It is also an objective of this invention to provide an inclined pulmonary-assisting mattress for infant and small children which is usable in medical facilities, nurseries, and in the home. A further object of this invention is to provide an inclined pulmonary-assisting mattress for infant and small children that can poses no risk for injury, breathing obstruction, or entrapment of any part of the infant or small child using it. In addition, it is an objective of this invention to provide an inclined pulmonary-assisting mattress for infant and small children with firm, but not rigid, support. It is also an objective of this invention to provide an inclined pulmonary-assisting mattress for infant and small children that is readily washable. A further objective of this invention is to provide an inclined pulmonary-assisting mattress for infant and small children that when used with a crib or other enclosure substantially fills the perimeter defined by the crib's interior surfaces.

The present invention is an inclined pulmonary-assisting mattress with a defined profile on its top surface that assists infants with respiratory problems, as well as those with colic, acid reflux, wheezing, asthma, sudden infant death syndrome (SIDS), cerebral palsy, ear infections, and other adverse medical conditions. It can be used with a crib, bassinette, or other defined infant sleeping area, as long as it fills that sleeping area so that no part of the infant is at risk for injury, entrapment, or breathing obstruction. In addition, the present invention inclined pulmonary-assisting mattress is not used on top of a crib mattress, but instead replaces a crib mattress until the infant recovers or outgrows the breathing difficulty or other adverse medical condition. When that occurs, the present invention inclined infant mattress is removed and the baby can be allowed to sleep on a regular crib mattress. The present invention has a preferred defined profile for its top surface that starting at its top end includes a horizontally-extending portion, an inclined upper torso support having an incline angle in the range of approximately 35-degrees to 45-degrees, a U-shaped concave area communicating with the bottom end of the upper torso support, an inverted U-shaped convex lower torso bump/stop that maintains a child's upper torso against the upper torso support, and a lower inclined portion for leg/foot support. While not strictly limited thereto, the horizontally-extending portion at the top end of the present invention extends longitudinally across approximately 10-percent of its total length, the height of the U-shaped concave area and the bottom end of the lower inclined portion for leg/foot support have a similar elevation, the height dimension of the horizontally extending portion at the top end of the present invention is approximately three times that of the bottom end of the lower inclined portion for leg/foot support, and the height dimension of the bump/stop is slightly less that double that of the U-shaped concave area and the bottom end of the lower inclined portion for leg/foot support. Also, it is contemplated for the curvature between the U-shaped concave area and the bump/stop to provide a smooth transition between them, and not an abrupt one to enhance infant/child comfort. Intended applications of the present invention include, but are not limited to, use in neonatal units in hospitals, children's nurseries, and by parents of infants suffering from many types of breathing and digestive issues. It is beneficial for children suffering from ear infections as well, as pressure tends to build up, causing a lot of pain for children sleeping in a flat position.

DETAILED DESCRIPTION OF THE INVENTION

Figure 1:
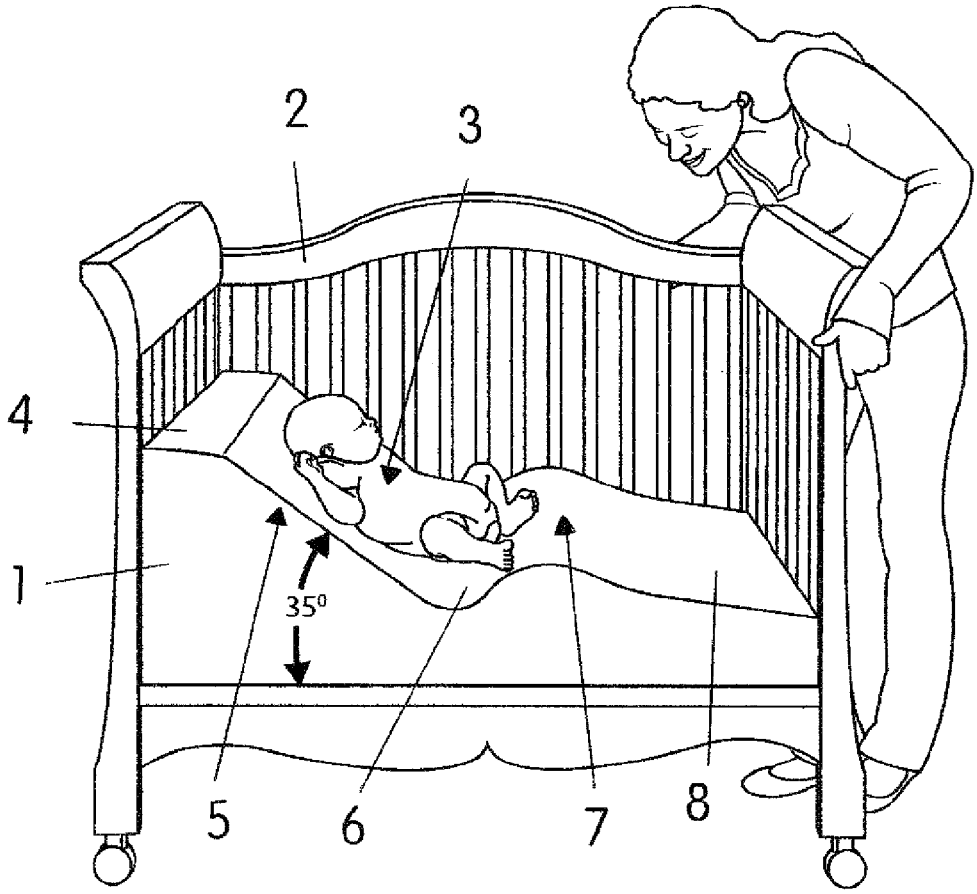
FIG. 1 is a perspective view from the side of a first preferred embodiment of the present invention inclined pulmonary-assisting mattress installed in a crib and showing it substantially filling the perimeter defined by the crib's interior surfaces, with the near side of the crib being removed for illustrative purposes.

The present invention is an inclined pulmonary-assisting mattress 1 with a defined profile on its top surface (4-8) that assists infants 3 with respiratory problems, as well as those with colic, acid reflux, wheezing, asthma, sudden infant death syndrome (SIDS), cerebral palsy, ear infections, and other adverse medical conditions. It can be used with a crib 2, bassinette, or other defined infant sleeping area, as long as it fills that sleeping area so that no part of the infant 3 is at risk for injury, entrapment, or breathing obstruction. In addition, the present invention inclined pulmonary-assisting mattress 1 is not used on top of a crib mattress (not shown), but instead replaces a crib mattress until the infant 3 recovers or outgrows the breathing difficulty or other adverse medical condition. When that occurs, the present invention inclined infant mattress 1 is removed and the baby/infant 3 can be allowed to sleep on a regular crib mattress.

The present invention 1 has a preferred defined profile (4-8) for its top surface that starting at its top end includes a horizontally-extending portion 4, an inclined upper torso support 5 having an incline angle in the range of approximately 35-degrees to 45-degrees, a U-shaped concave area 6 communicating with the bottom end of the upper torso support 5, an inverted U-shaped convex lower torso bump/stop 7 that maintains a child's upper torso against the upper torso support 5, and a lower inclined portion 8 for leg/foot support. While not strictly limited thereto, the horizontally-extending portion 4 at the top end of the present invention extends longitudinally across approximately 10-percent of the present invention's total length, the height of the U-shaped concave area 6 and the bottom end of the lower inclined portion 8 for leg/foot support have a similar elevation, the height dimension of the horizontally extending portion 4 at the top end of the present invention is approximately three times that of the bottom end of the lower inclined portion 8 used for leg/foot support, and the height dimension of the inverted U-shaped convex bump/stop 7 is slightly less that double that of the U-shaped concave area 6 and the bottom end of the lower inclined portion 8 for leg/foot support. Also, it is contemplated for the curvature between the U-shaped concave area 6 and the inverted U-shaped convex bump/stop 7 to provide a smooth transition between them, and not an abrupt one for enhanced stability of the infant 3 or small child (not shown). Intended applications of the present invention inclined pulmonary-assisting mattress 1 include, but are not limited to, use in neo-natal units in hospitals, children's nurseries, and by parents of infants suffering from many types of breathing and digestive issues. FIGS. 1-5 show a first preferred embodiment of the present invention and FIG. 6 shows a second preferred embodiment with a small ridge 9 around its perimeter surface.

FIGS. 1-5 show a first preferred embodiment of the present invention inclined pulmonary-assisting mattress 1 in a crib 2 and replacing the original mattress (not shown) used by children without breathing and digestion related medical issues. FIG. 1 is a perspective view from the side of a first preferred embodiment of the present invention mattress 1, showing it substantially filling the perimeter defined by the crib 2 interior surfaces, with the near side of crib 2 being removed for illustrative purposes. FIG. 1 also shows an infant 3 with its head and most of its torso positioned against the upper torso support 5, and the hips and legs of child 3 engaging the concave area 6 communicating with the bottom end of the upper torso support or the convex lower torso bump/stop 7. In FIG. 1, the top surface of bump/stop 7 is shown to have an elevation above the lower end of lower torso support 8 that is approximately one-third that of said top end of said upper torso support 5. In addition, in FIG. 1 the U-shaped concave area 6 depending from the lower end of the support torso support 5 comprises an arc from a circle having a smaller diameter dimension than that of the convex lower torso bump/stop 7, creating a stop for the hips and legs of an infant to maintain optimal positioning of the infant's shoulders and back against the upper torso support during use, the contiguous connection between the U-shaped concave area 6 and the convex lower torso bump/stop 7 also being non-angular and providing a smooth transition between them for enhanced comfort to the infant or child using it. Although use of the present invention mattress 1 in FIG. 1 is shown with a crib 2, it is also contemplated for the present invention mattress 1 to be used with a bassinette, and other defined sleeping area where its size appreciably fills or otherwise complements the area to eliminate all risk of infant/child injury, entrapment, and breathing obstruction. Furthermore and although not shown, with increased adult supervision, and particularly when used with younger children who do not reposition themselves frequently during sleep, the pulmonary-assisting mattress 1 of the present invention can be placed on a floor or other flat surface in a position away from objects (soft or hard), young siblings, or access by pets or other things that could impair the health or well being of the infant or small child while asleep.

Figure 2:
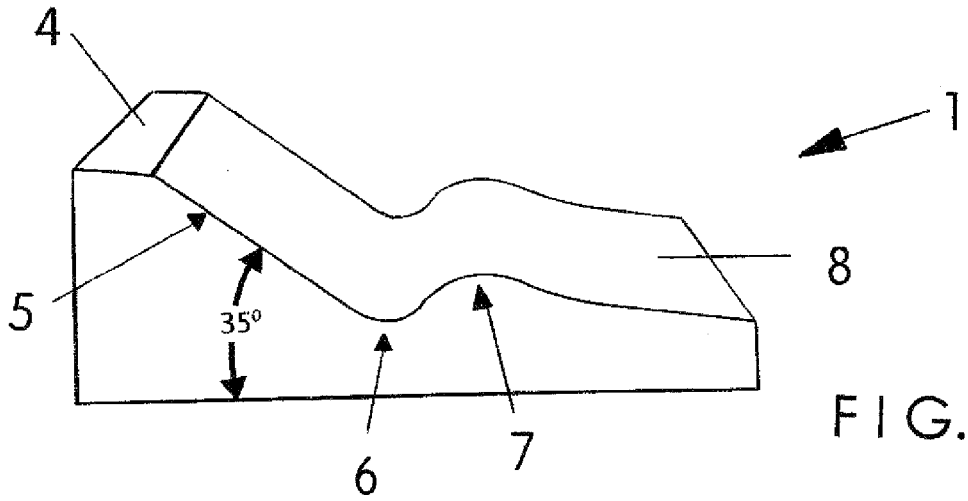
FIG. 2 is a perspective view from the side of the first preferred embodiment of the present invention mattress shown in FIG. 1 without the crib and infant.
Figure 3:
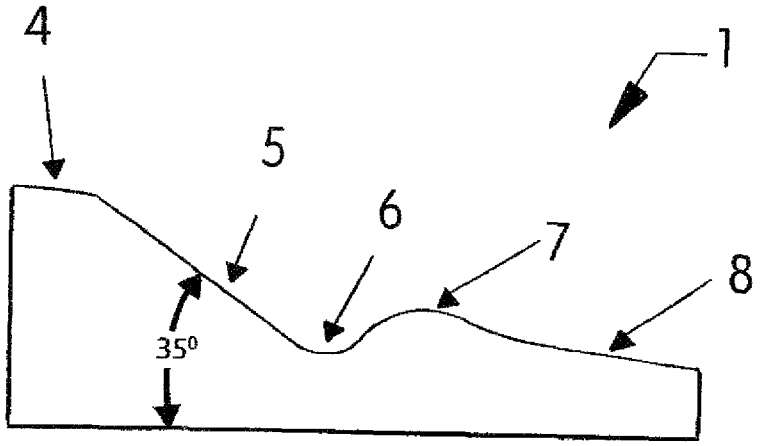
FIG. 3 is a side view of the first preferred embodiment of the present invention mattress showing the inclined upper torso support portion thereof having an angle of approximately 35-degrees relative to the horizontally-extending bottom surface of the mattress.
Figure 4:
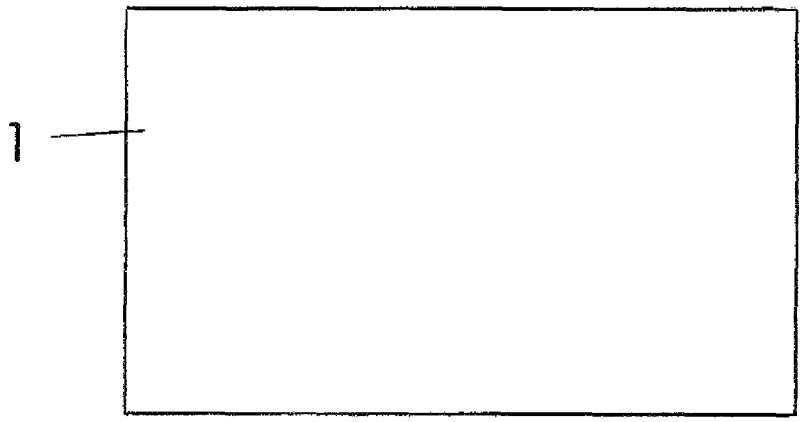
FIG. 4 is a bottom view of the first preferred embodiment of the present invention mattress shown in FIG. 1, showing the bottom surface of the mattress unadorned.
Figure 5:
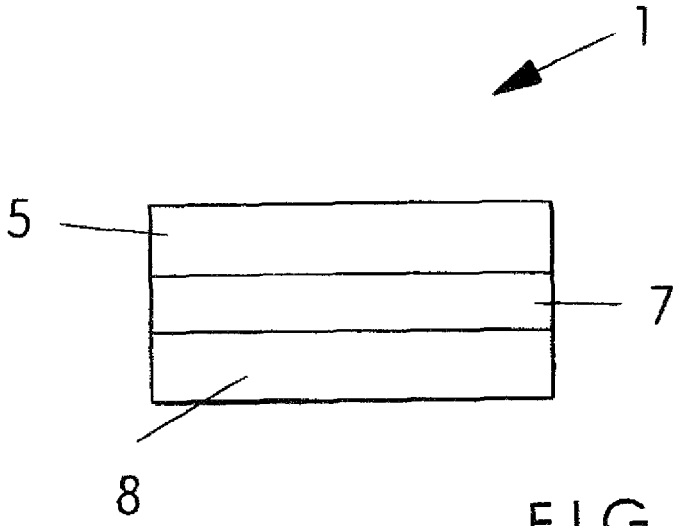
FIG. 5 is an end view of a first preferred embodiment of the present invention mattress showing its lower inclined portion for leg/foot support, the inverted U-shaped convex lower torso bump/stop, and the inclined upper torso support.
Figure 6:
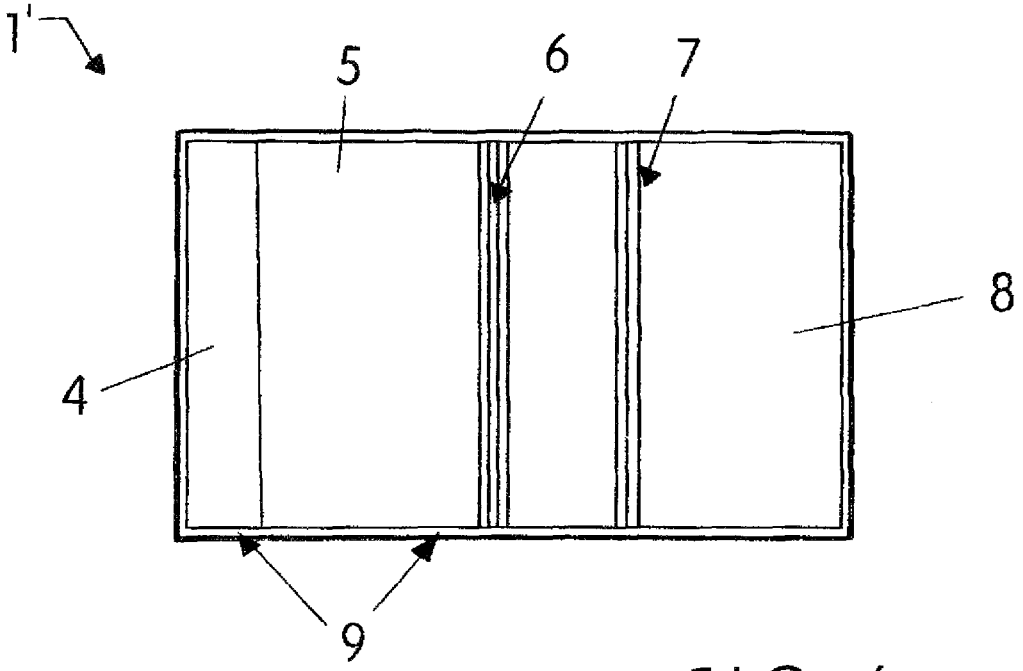
FIG. 6 is a top view of a second preferred embodiment of the present invention inclined pulmonary-assisting mattress revealing the same features shown in FIG. 1, with the addition of a small upwardly-extending ridge around the perimeter of the mattress's top surface.

FIGS. 2-5 also show the first preferred embodiment 1 of the present invention, while and FIG. 6 shows a second preferred embodiment 1' having a small ridge 9 around its perimeter surface. To avoid breathing obstruction issues, perimeter ridge 9 is contemplated to be less than 2 cm in most applications. FIG. 2 is a perspective view from the side of the first preferred embodiment 1 of the present invention mattress shown in FIG. 1 without the crib 2 and infant 3. Although in FIGS. 1-3 the angle for the inclined upper torso support 5 is identified as 35-degrees, in preferred embodiments of the present invention (1, 1', and other) it is contemplated for the inclined angle of inclined upper torso support 5 to be in the range of approximately 35-degrees to approximately 45-degrees. FIG. 3 is a side view of the first preferred embodiment 1 of the present invention mattress the inclined upper torso support portion 5 thereof having an angle of approximately 35-degrees relative to the horizontally-extending bottom surface of the mattress. FIG. 4 is a bottom view of the first preferred embodiment 1 of the present invention shown in FIG. 1, showing the bottom surface thereof uniform and unadorned. FIG. 5 is an end view of a first preferred embodiment of the present invention mattress showing its lower inclined portion for leg/foot support 8, the convex lower torso bump/stop 6, and the inclined upper torso support 5.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods identified in the accompanying claims, and also within the scope and spirit of the invention.

We claim:

1. An inclined pulmonary-assisting mattress for infants and small children, said mattress comprising:

an inclined upper torso support with a top end, a bottom end, and a minimum upward incline angle from horizontal of approximately 35-degrees causing said top end to have a higher elevation than said bottom end, a centrally-positioned U-shaped concave area having a first end contiguous with said bottom end of said inclined upper torso support;

said U-shaped concave area having a second end contiguous with a first end of an inverted U-shaped convex area, said concave area and said convex area together creating a lower torso stop engaging the hips and legs of infants and small children using said mattress that maintains optimal positioning of the head and back of the infants and small children against said upper torso support, said concave and convex areas comprising arcs from circles having different diameter dimensions, said concave area comprising an arc from a circle having a smaller diameter dimension than that of said convex area, said contiguous connection between said concave area and said convex area being non-angular and providing a smooth transition between them for enhanced comfort to the infants and small children using said mattress;

a lower inclined portion having a top end contiguous with a second end of said convex area, said lower inclined area also having a bottom end, said top end having a higher elevation than said bottom end; and said U-shaped concave area has a height dimension substantially similar to that of said bottom end of said lower inclined portion, wherein when an infant or small child is placed with its head and back against said inclined upper torso support, the hip area of the infant or small child at least in part engages said U-shaped concave area, and at least a portion of the legs of the infant or small child engages said lower torso stop, providing a sleeping position for the infant or small child that assists infants and small children with adverse breathing and digestive conditions, and those with ear infections and other adverse medical conditions, enhancing their stability and comfort during sleep.

2. The mattress of claim 1 wherein said top end of said inclined upper torso support has a height dimension approximately three times that of said bottom end of said lower inclined portion.

3. The mattress of claim 1 wherein said U-shaped concave area and said top end of said inclined upper torso support each have a height dimension, and said height dimension of said top end of said inclined upper torso support is approximately three times said height dimension of said U-shaped concave area.

4. The mattress of claim 1 wherein said U-shaped concave area and said inverted U-shaped convex area each have a height dimension, and said height dimension of said inverted U-shaped convex area is slightly less than twice said height dimension of said U-shaped concave area.

5. The mattress of claim 1 wherein said contiguous connection between said U-shaped concave area and said inverted U-shaped convex area is non-angular, providing a smooth transition between them for enhanced comfort of the infants and small children using said mattress.

6. The mattress of claim 1 wherein said lower inclined portion is positioned for support of at least a portion of a user's legs and feet.

7. The mattress of claim 1 wherein said top surface comprises a perimeter edge, and further comprising an upwardly-extending ridge around at least a portion of said perimeter.

8. The mattress of claim 7 wherein said ridge has a maximum height dimension of approximately two centimeters.

9. A method for using the mattress of claim 1, said method comprising the steps of:

providing said mattress of claim 1, a crib defining an interior sleeping area, and an infant;

placing said mattress in said crib so that it substantially covers said interior sleeping area; and placing the back and head of said infant against said inclined upper torso support while concurrently adjusting positioning of said infant to place the hip area of said infant at least partially within said U-shaped concave area and at least a portion of the legs of said infant in contact with said inverted U-shaped convex.

10. A method for using the mattress of claim 1, said method comprising the steps of:

providing said mattress of claim 1, a crib defining an interior sleeping area, and a small child;

placing said mattress in said crib so that it substantially covers said interior sleeping area; and placing the back and head of said small child against said inclined upper torso support while concurrently adjusting positioning of said small child to place the hip area of said small child at least partially within said U-shaped concave area and at least a portion of the legs of said small child in contact with said inverted U-shaped convex area; and placing the legs and feet of said small child in contact with said lower inclined portion.

11. The mattress of claim 1 wherein said convex area has a top surface, and said top surface has an elevation above said lower end of said lower torso support that is approximately one-third that of said top end of said inclined upper torso support.

12. The mattress of claim 1 wherein said inclined upper torso support has an upward incline angle between approximately 35-degrees and approximately 45-degrees.

13. The mattress of claim 1 further comprising a horizontally-extending portion depending from said top end of said inclined upper torso support.

14. The mattress of claim 1 wherein horizontally-extending portion has a longitudinally-extending length dimension approximately 10-percent that of said mattress.

* * * * *